US008292657B2

(12) United States Patent
Singh

(10) Patent No.: US 8,292,657 B2
(45) Date of Patent: Oct. 23, 2012

(54) PORTABLE ELECTRICAL POWER BOX

(76) Inventor: Jagdeo Singh, Laurel, MS (US)

( * ) Notice: Subject to any disclaimer, the term of this patent is extended or adjusted under 35 U.S.C. 154(b) by 87 days.

(21) Appl. No.: 12/891,371

(22) Filed: Sep. 27, 2010

(65) Prior Publication Data

US 2011/0104937 A1 May 5, 2011

Related U.S. Application Data

(60) Provisional application No. 61/272,791, filed on Nov. 3, 2009.

(51) Int. Cl.
*H01R 11/00* (2006.01)

(52) U.S. Cl. ..... 439/505; 307/38

(58) Field of Classification Search ..... 439/135–141, 439/502–507; 307/31, 38–40
See application file for complete search history.

(56) References Cited

U.S. PATENT DOCUMENTS

| | | | | |
|---|---|---|---|---|
| 4,131,805 | A | 12/1978 | Austin et al. | |
| 4,657,332 | A | 4/1987 | Stillman | |
| 4,749,360 | A | 6/1988 | Dudley et al. | |
| 5,439,390 | A | 8/1995 | Raynor et al. | |
| 5,579,201 | A | 11/1996 | Karageozian | |
| 5,936,828 | A | 8/1999 | Nolan et al. | |
| 6,445,087 | B1 * | 9/2002 | Wang et al. | 307/40 |
| 6,666,712 | B1 * | 12/2003 | Kramer | 439/501 |
| 6,744,150 | B2 | 6/2004 | Rendic | |
| 6,805,579 | B2 | 10/2004 | Marchand et al. | |
| 6,882,530 | B2 | 4/2005 | Cyphers et al. | |
| 6,933,447 | B1 | 8/2005 | Marc | |
| 7,132,763 | B2 * | 11/2006 | Rendic | 307/31 |
| 7,210,960 | B2 * | 5/2007 | Mak | 439/505 |
| 7,227,755 | B1 | 6/2007 | Arnold et al. | |
| 7,663,866 | B2 * | 2/2010 | Lee et al. | 361/601 |
| 7,906,869 | B2 * | 3/2011 | Lee et al. | 307/40 |
| 7,956,492 | B2 * | 6/2011 | Lee et al. | 307/38 |
| 2007/0109736 | A1 | 5/2007 | Coglitore | |

* cited by examiner

*Primary Examiner* — Thanh Tam Le
(74) *Attorney, Agent, or Firm* — Richard C. Litman

(57) ABSTRACT

The portable electrical power box includes a power extension cord connected to a 240-volt input plug. Via the input plug, the device plugs into a 240-volt outlet in a home or other location where split phase power is available. Two branch circuits comprise 120-volt receptacles disposed on the power box. The power extension cord has a neutral wire, a first split voltage wire, and a second split voltage wire. The neutral and first split voltage wire feed voltage to the first branch circuit of receptacles. The neutral and second split voltage wire feed voltage to the second branch circuit of receptacles. This arrangement minimizes overloading electrical panels in homes with extension cords in the home's 120-VAC outlets. The device has circuit breakers to prevent overloads.

6 Claims, 4 Drawing Sheets

PORTABLE ELECTRICAL POWER BOX

CROSS-REFERENCE TO RELATED APPLICATION

This application claims the benefit of U.S. Provisional Patent Application Ser. No. 61/272,791, filed Nov. 3, 2009.

BACKGROUND OF THE INVENTION

1. Field of the Invention

The present invention relates to electrical power distribution, and more specifically to a portable electrical power box that plugs into a 240-volt split phase power outlet and provides power to two 120-volt outlet branches.

2. Description of the Related Art

During special events and winter holidays, extension cords are often used to power extra appliances, lighting or electronics. Typically an extension cord is plugged into one outlet to serve many appliances, lights, equipment, and the like. Using extension cords in this manner often means that an overload is more likely to occur due to load imbalances caused by the extra equipment coming off of one outlet. When such an overload causes a power outage, users of the extension cord get frustrated in their attempt to use the extra electronic gadgetry, lights, etc. An often forgotten power source is the 240-volt outlet because generally, with the exception of a refrigerator, clothes dryer or washing machine, the users do not need to utilize the 240-volt outlet. However, the 240-volt outlet could be utilized to avoid the aforementioned overload problem. Moreover, construction site power generators rarely come equipped with a sufficient number of 120-volt receptacles. What is needed is a device that would augment the capability of portable electrical generators as well.

Thus, a portable electrical power box solving the aforementioned problems is desired.

SUMMARY OF THE INVENTION

The portable electrical power box includes a power extension cord connected to a 240-volt plug. The device plugs into a 240-volt outlet in a home or other location where split phase power is available.

Two branch circuits are comprised of 120-volt receptacles disposed on the power box. The power extension cord has a neutral wire, a first split voltage wire, and a second split voltage wire. The neutral and first split voltage wires feed voltage to the first branch circuit of receptacles. The neutral and second split voltage wires feed voltage to the second branch circuit of receptacles.

This arrangement minimizes overloading electrical panels in homes with extension cords in the home's 120-VAC outlets. The device further includes circuit breakers to prevent overloads.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
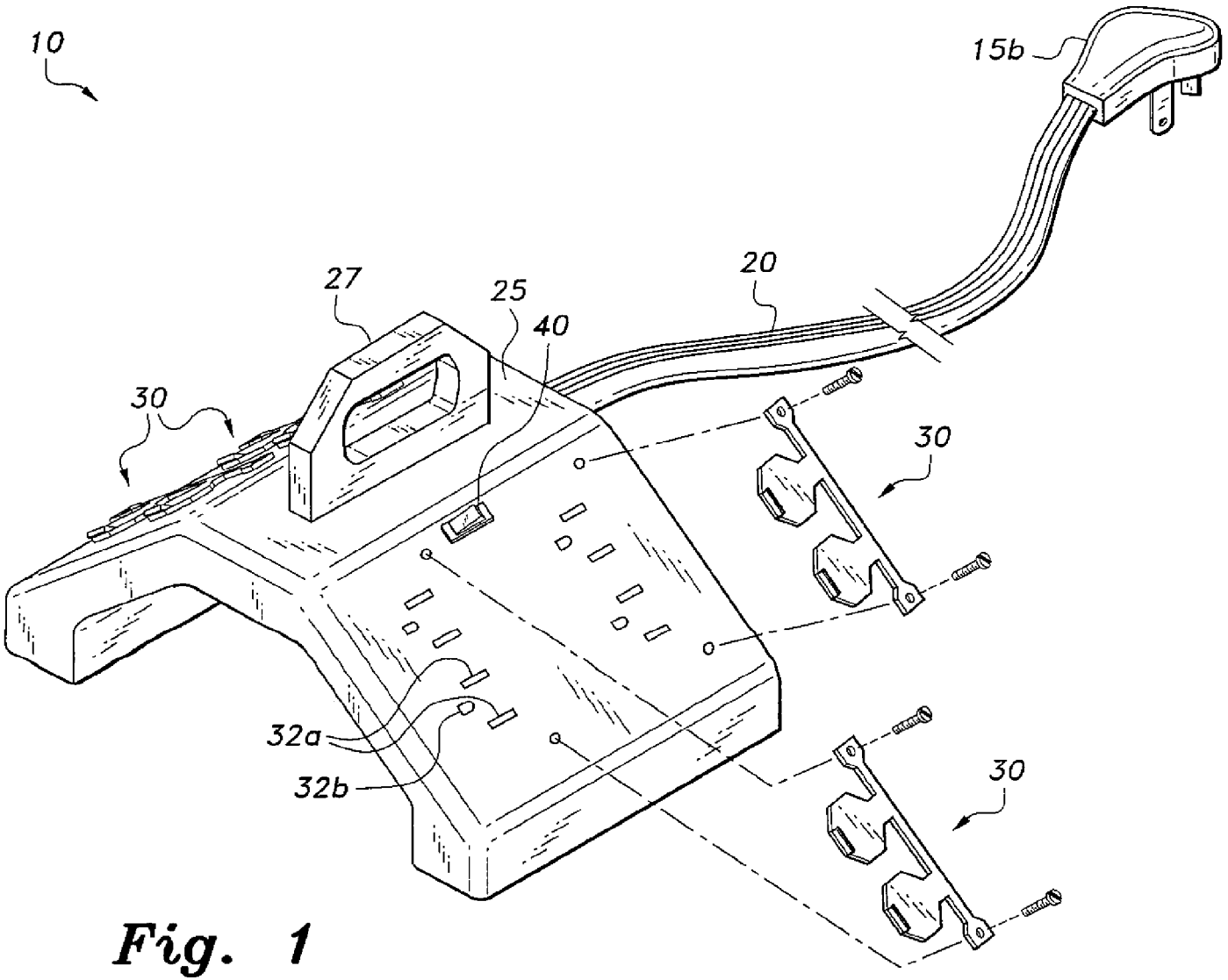
FIG. 1 is an environmental, perspective view of a portable electrical power box according to the present invention.
Figure 3:
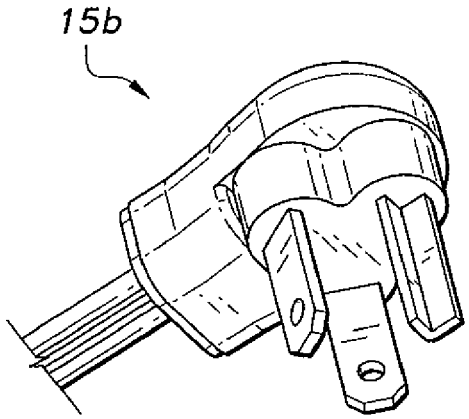
FIG. 3 is a perspective view of a first embodiment of a cord plug for the portable electrical power box according to the present invention.
Figure 4:
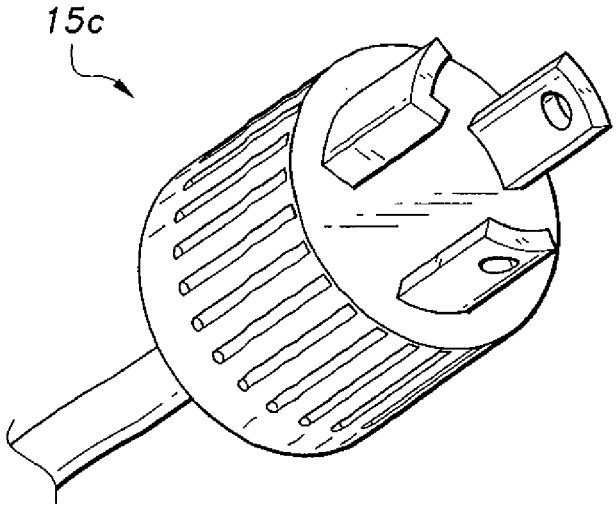
FIG. 4 is a perspective view of a second embodiment of a cord plug for the portable electrical power box according to the present invention.
Figure 5:
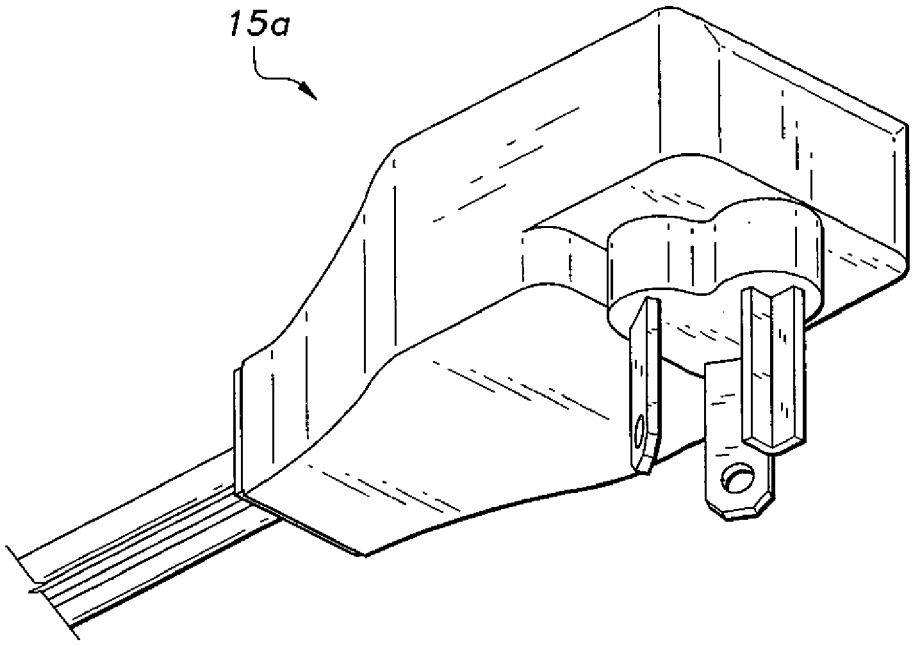
FIG. 5 is a perspective view of a third embodiment of a cord plug for the portable electrical power box according to the present invention.

As shown in FIG. 1, the portable electrical power box 10 is a receptacle housing that includes a power extension cord 20 extending therefrom. The power extension cord 20 connects to a high voltage input plug 15*b*. The high voltage input plug 15*b* preferably plugs into a high-voltage output terminal or receptacle, such as a 240-volt output receptacle. In the embodiment shown in FIGS. 2 and 5, the input plug 15*a* is a high voltage ground fault circuit interrupter (GFCI) plug that is configured to be received by a National Electrical Manufacturer's Association (NEMA) 10-30R receptacle. This plug 15*a* has dual test buttons, dual test lights, and dual reset buttons, and is fully equipped to service two 120-Volt circuit branches. As shown in FIGS. 1, 3 and 4, the device 10 may incorporate NEMA compatible plugs configured to receive high voltage outputs, such as NEMA 10-30 plug 15*b*, or plug 15*c*, which also is compatible with the popular 10-30R receptacle type.

The power box shown in FIG. 1 has a top surface 25 and two service panels, which extend downward at an angle from opposing sides of the top surface 25, thereby creating an open space between the two panels. Optionally, a handle 27 may extend upward from the top surface 25, the handle providing an easy method for carrying the device 10.

The portable electrical power box 10 plugs into a 240-volt outlet in a home or other location where split phase power is available.

Figure 2:
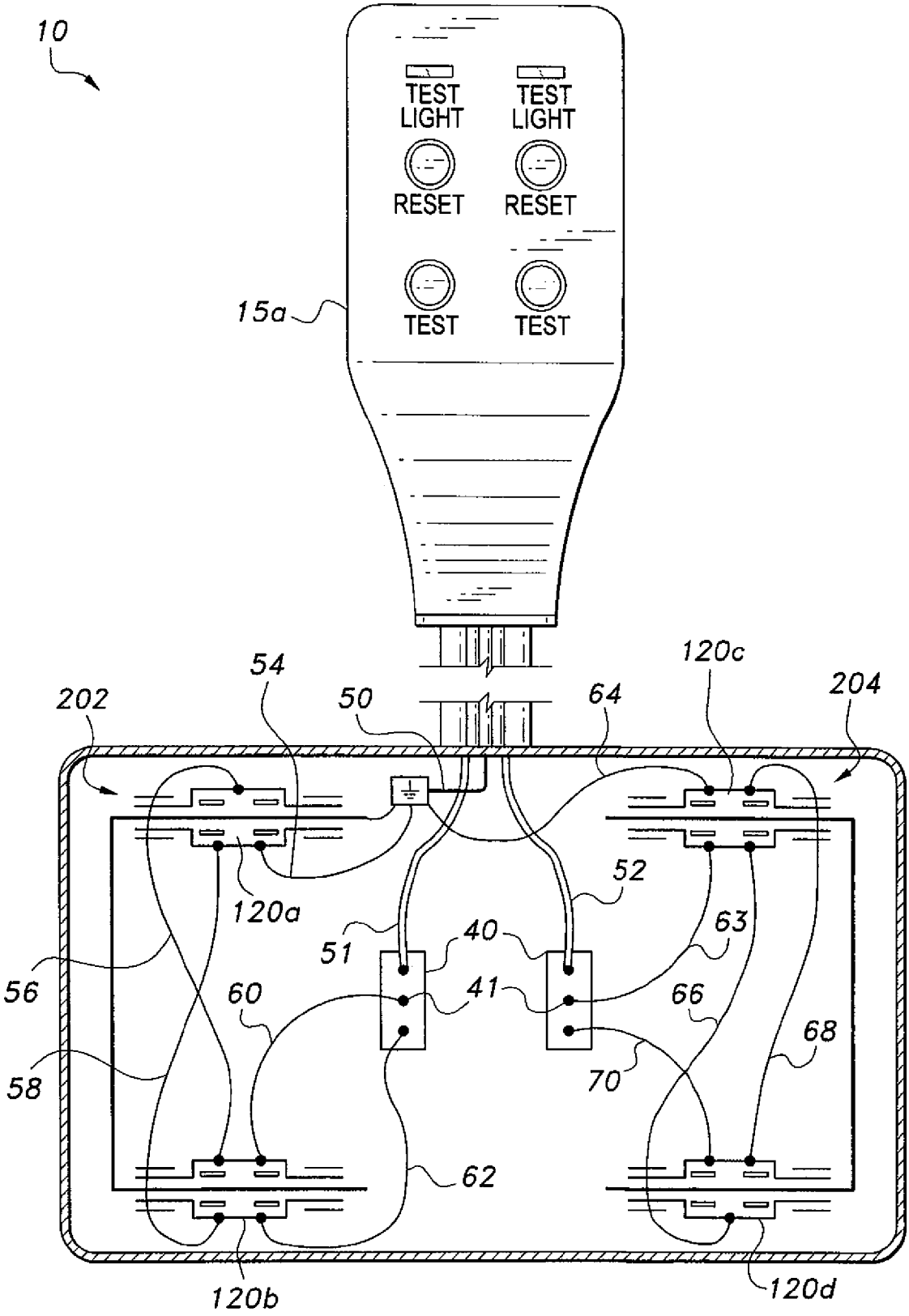
FIG. 2 is a schematic diagram of the portable electrical power box according to the present invention.

As shown in FIG. 2, a first branch circuit 202 comprises dual receptacles 120*a* and 120*b*. On an opposing side of the device 10, a second branch circuit 204 comprises dual 120-volt receptacles 120*c* and 120*d*. The power extension cord 20 has a neutral wire 50, a first split voltage wire 51, and a second split voltage wire 52. The neutral wire 50 and first split voltage wire 51 feed voltage to the first branch circuit 202, comprising receptacles 120*a* and 120*b*. The neutral 50 and second split voltage wire 52 feed voltage to the second branch circuit 204, comprising receptacles 120*c* and 120*d*.

As most clearly shown in FIG. 2, the split voltage feed to the different branch circuits 202 and 204 is symmetrical in design. Branch circuit 202 neutral feed comprises connector wire 54, which connects the bottom side of dual receptacle 120*a* to the neutral feed 50. The bottom side of dual receptacle 120*a* is connected to the bottom side of dual receptacle 120*b* via connecting wire 58. The top side of dual receptacle 120*a* is connected to the top side of dual receptacle 120*b* via connecting wire 56. The circuit is completed via one of the circuit breaker switch combos 40 being connected between first split voltage wire 51 and the bottom side of dual receptacle 120*b* by hot connector wire 62. This configuration will help prevent fire and overload. Connector wire 60 connects to the top portion of dual receptacle 120*b* and provides power to illuminate the switch 40 when the switch is actuated to energize receptacles 120*a* and 120*b*, which, due to the aforementioned split circuitry, provide 120-volts A.C. for the consumer.

Similarly, with respect to branch circuit 204, the neutral feed comprises connector wire 64, which connects the top side of dual receptacle 120*c* to the neutral feed 50. The bottom side of dual receptacle 120*c* is connected to the bottom side of dual receptacle 120*d* via connecting wire 66. The top side of dual receptacle 120*c* is connected to the top side of dual receptacle 120*d* via connecting wire 68. The circuit is completed via another circuit breaker switch combo 40 being connected between the second split voltage wire 52 and the top side of dual receptacle 120*d* by hot connector wire 70. Connector wire 63 connects to the bottom portion of dual receptacle 120*c* and provides power to illuminate the switch 40 when the switch is actuated to energize receptacles 120*c* and 120*d*, which, due to the aforementioned split circuitry, provide 120-volts A.C. for the consumer.

When plugged in to a high voltage split phase power source, the power box 10 provides a balanced load, which minimizes overloading electrical panels in homes with extension cords in the home's 120-VAC outlets. Flexible protectors 30 are attached to the device 10 and cover receptacle slots 32*a* and 32*b* when they are not in use.

Figure 6:
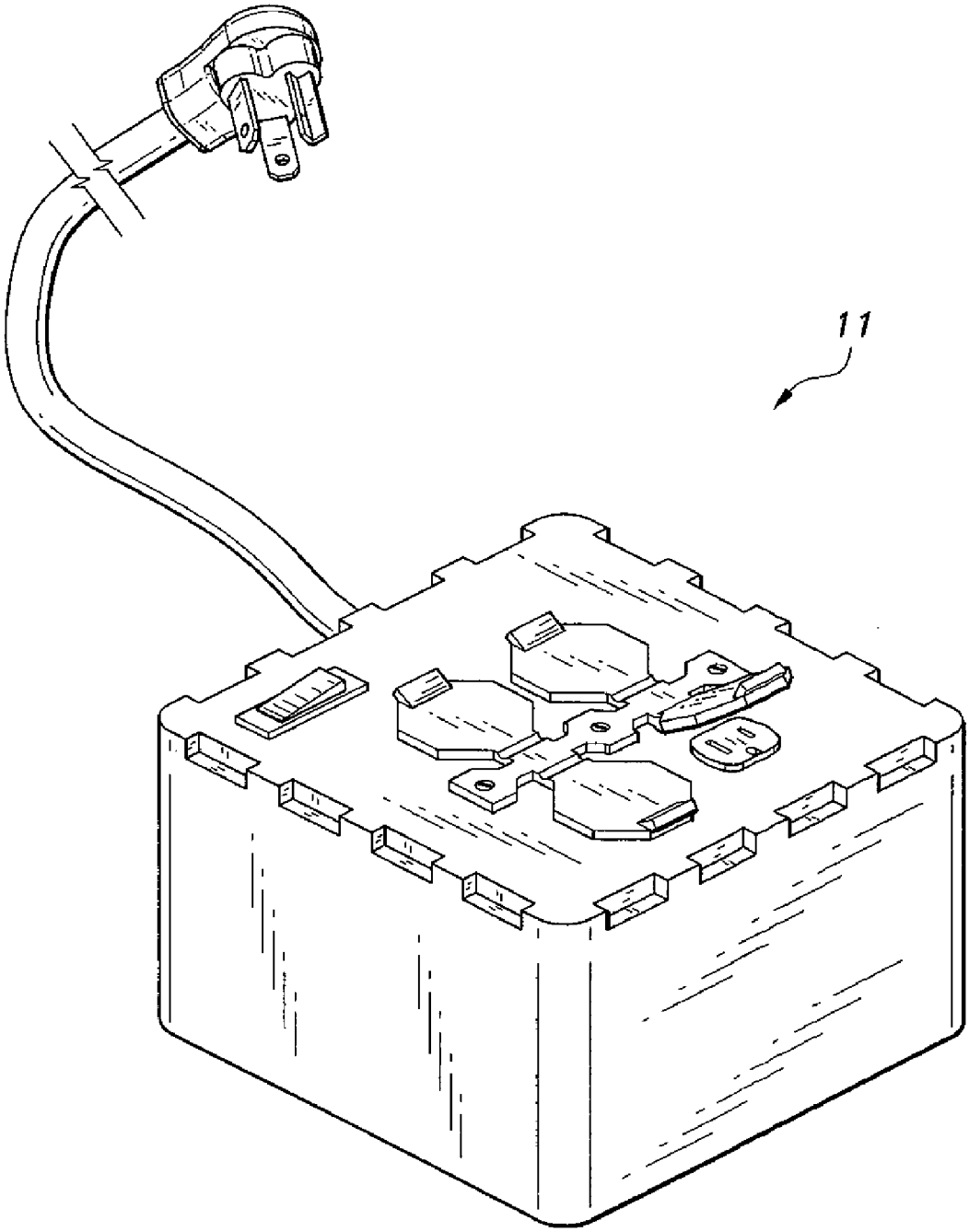
FIG. 6 is an environmental, perspective view of an alternative embodiment of the portable electrical power box according to the present invention.

Alternatively, the power distribution device may be shaped like box 11, shown in FIG. 6. Electrical operation of box 11 is the same as device 10. The portable electrical power box 10 or the alternatively shaped power box 11 can also be used as an electric vehicle charging station.

It is to be understood that the present invention is not limited to the embodiments described above, but encompasses any and all embodiments within the scope of the following claims.

I claim:

1. A portable electrical power box, comprising:

a housing;

a cable having three electrically conducting wires, the cable extending from the housing, the three wires including a first wire being a neutral wire, a second wire adapted for carrying a first split voltage with respect to the neural first wire, and a third wire adapted for carrying a second split voltage with respect to the neural first wire;

a high voltage electrical plug having three prongs adapted for insertion into a corresponding receptacle of a split phase high voltage power source, the three wires of the cable being electrically connected to the three prongs of the plug;

a first pair of voltage receptacles disposed on a first portion of the housing;

a second pair of voltage receptacles disposed on an opposite portion of the housing; and first and second switches electrically connected to circuitry of said first and second pairs of voltage receptacles, said first and said second switches selectively energizing said first and second pairs of voltage receptacles to supply electrical power therefrom;

wherein the neutral wire is routed and electrically connected to a common non-electrically hot side of the first and second pairs of voltage receptacles in the housing;

wherein the second wire is routed and electrically connected to an electrically hot side of the first pair of voltage receptacles;

wherein the third wire is routed and electrically connected to an electrically hot side of the second pair of voltage receptacles; and wherein said high voltage electrical plug further comprises a high voltage ground fault circuit interrupter (GFCI) having dual test buttons, dual test lights, and dual reset buttons, wherein the dual test buttons, dual test lights, and dual reset buttons, respectively, being configured for testing, indicating, and resetting an associated 120-Volt output of the first and second pair of voltage receptacles.

2. The portable electrical power box according to claim 1, wherein said housing comprises:

a top surface; and two service panels extending downward at an angle from opposing sides of the top surface, thereby creating an open space between the two panels.

3. The portable electrical power box according to claim 1, further comprising flexible, electrically insulating members removably disposed over electrically conductive portions of said first and second pairs of voltage receptacles, thereby protecting said electrical power box from inadvertent insertion of anything into said split first and second pairs of voltage receptacles.

4. The portable electrical power box according to claim 1, wherein said first and second switches further comprise overload protection circuitry selectively interrupting power supplied to any one of the first or second pairs of voltage receptacles when the any one of the first or second pairs of voltage receptacles is energized and experiencing electrical overload conditions.

5. The portable electrical power box according to claim 1, wherein said cable is designed to accept 240-volt split phase from an external split phase power source.

6. The portable electrical power box according to claim 1, wherein said first pair of voltage receptacles delivers one-half the total voltage carried by said cable and said second pair of voltage receptacles delivers one-half the total voltage carried by said cable.

* * * * *